US005973615A

United States Patent [19]

Shima

[11] Patent Number: 5,973,615

[45] Date of Patent: Oct. 26, 1999

[54] DISPLAY PAGER HAVING MESSAGE FINDER RESPONSIVE TO USER-ENTERED TIME INDICATION

[75] Inventor: Makoto Shima, Shizuoka, Japan

[73] Assignee: NEC Corporation, Tokyo, Japan

[21] Appl. No.: 08/997,670

[22] Filed: Dec. 23, 1997

[30] Foreign Application Priority Data

Dec. 25, 1996 [JP] Japan ..... 8-346149

[51] Int. Cl.[6] ..... G08B 5/22

[52] U.S. Cl. ..... 340/825.44; 340/825.47; 340/825.52

[58] Field of Search ..... 340/825.44, 825.47, 340/825.52; 455/226.2, 38.1, 412, 67.1, 67.7, 458, 519; 368/10, 47, 28, 73

[56] References Cited

U.S. PATENT DOCUMENTS 5,128,665 7/1992 DeLuca et al. ..... 340/825.47

5,475,380 12/1995 Shim ..... 340/825.44

5,635,914 6/1997 Petreye et al. ..... 340/825.44

FOREIGN PATENT DOCUMENTS 60-106237 11/1985 Japan .

*Primary Examiner*—Michael Horabik

*Assistant Examiner*—Jean B. Jeanglaude

*Attorney, Agent, or Firm*—Scully, Scott, Murphy & Presser

[57] ABSTRACT

In a radio display pager, the user enters a time indication if he desires to read a particular group of stored messages. If the time indication is entered, the particular group of messages is detected from the stored messages and each of the detected messages is displayed in response to a key operation by the user. If the time indication is not entered, each of the stored messages is displayed in response to a key operation on the keypad by the user.

14 Claims, 4 Drawing Sheets

MESSAGE MEMORY 5

DISPLAY PAGER HAVING MESSAGE FINDER RESPONSIVE TO USER-ENTERED TIME INDICATION

BACKGROUND OF THE INVENTION

1. Field of the Invention

The present invention relates generally to radio display pagers, and more specifically to the management of received messages stored in a radio display pager.

2. Description of the Related Art

Japanese Laid-Open Patent Specification Sho-60-106237 describes a radio display pager in which received messages are stored in a memory together with their arrival times. The stored messages are displayed starting with the message of most recent arrival and the user is required to scroll through messages of earlier arrivals. If the user desires to read messages of earlier arrivals, he has to scroll down many messages if a large number of messages have been received in the past. Such a situation occurs frequently for heavy users who receive several tens of messages each day.

SUMMARY OF THE INVENTION

It is therefore an object of the present invention to provide a radio display pager which relieves the user of having to scroll many messages when he desires to read a particular group of messages by sorting stored messages according to a user-entered time indication.

According to one aspect of the present invention, there is provided a radio display pager for receiving messages addressed to the pager, comprising a memory for storing the received messages, a display unit, a keypad for allowing a user to enter time indication, and control circuitry for detecting a group of messages according to the time indication and causing each of the detected messages to be displayed on the display unit in response to a key operation on the keypad by the user.

According to another aspect of the present invention, a method is provided for displaying messages stored in a memory of a radio display pager. The method comprises determining whether or not time indication is entered by a user. If the time indication is entered, a group of messages is detected according to the time indication and each of the detected messages is displayed in response to a key operation by the user. If the time indication is not entered, each of the stored messages is displayed in response to the key operation.

BRIEF DESCRIPTION OF THE DRAWINGS

The present invention will be described in further detail with reference to the accompanying drawings, in which.

DETAILED DESCRIPTION

Figure 1:
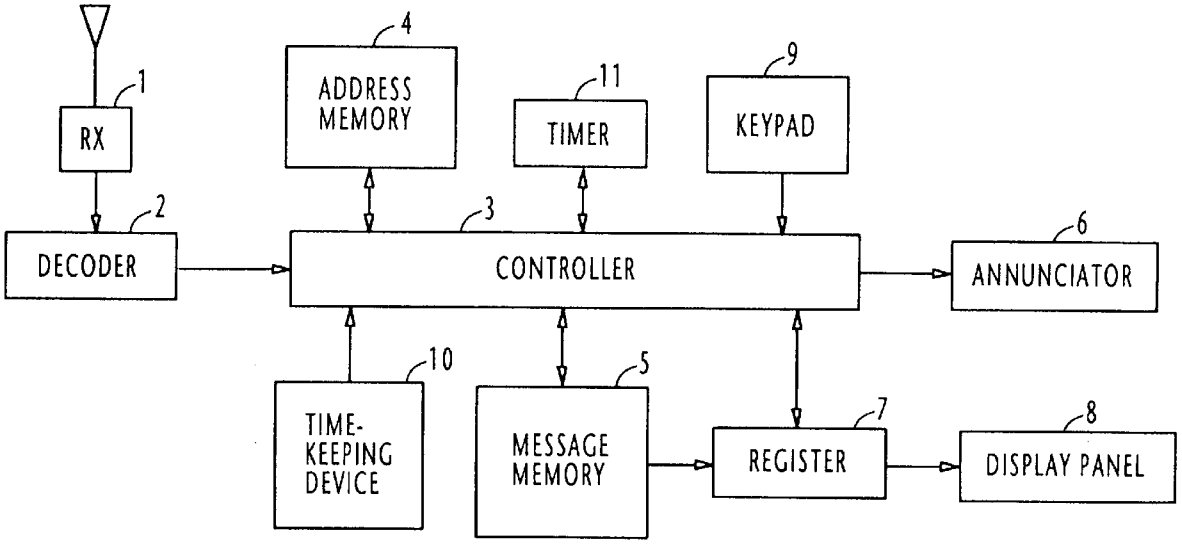
FIG. 1 shows, in a block diagram, a radio display pager of the present invention.

As shown in FIG. 1, the radio display pager of the present invention comprises a radio receiver 1 for receiving paging signals transmitted in a sequence of successive frames each containing an address field for indicating a destination pager's identifier, and a data field containing a message. The signals contained in the address and data fields are encoded at the transmit site into a special code that allows transmission errors to be corrected at the receive site. The decoder 2, connected to the output of the receiver 1, provides decoding of the received coded signals and the original signals recovered by the decoder are fed to a controller 3, where the identifier contained in the address field is compared with the pager's identifier pre-stored in an address memory or EEPROM (electrically erasable programmable read only memory) 4. If they match, the contents of the data field are stored in a message memory 5 and the user is alerted by an annunciator 6 and the message will then be loaded into a buffer register 7 and displayed on a display panel 8 when the pager's user operates a key on a keypad 9. Controller 3 is further associated with a time-keeping device 10 and a timer 11. Time-keeping device 10 supplies the controller with current time data indicating the minute, the time-of-day) the day, the month and the year. Although not shown in the drawing, the keypad 9 may include a scroll key, a protect key and an erase key.

Figure 2:
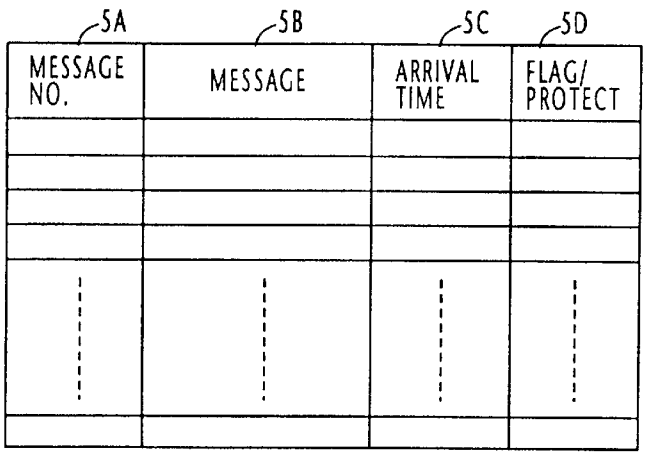
FIG. 2 shows details of the message memory of the pager.

As shown in FIG. 2, the message memory 5 is partitioned into a plurality of columns 5A to 5E which are divided into rows, or fields. Message numbers are stored in fields 5A, received messages are stored in fields 5B, and their arrival times in fields 5C. Fields 5D are flag/protect fields which are used to store flag bits to specify desired arrival time or time span in a manner as will be discussed. Protect bits are also stored in fields 5D, instead of flag bits, as indications to prevent desired messages from being erased.

Figure 3:
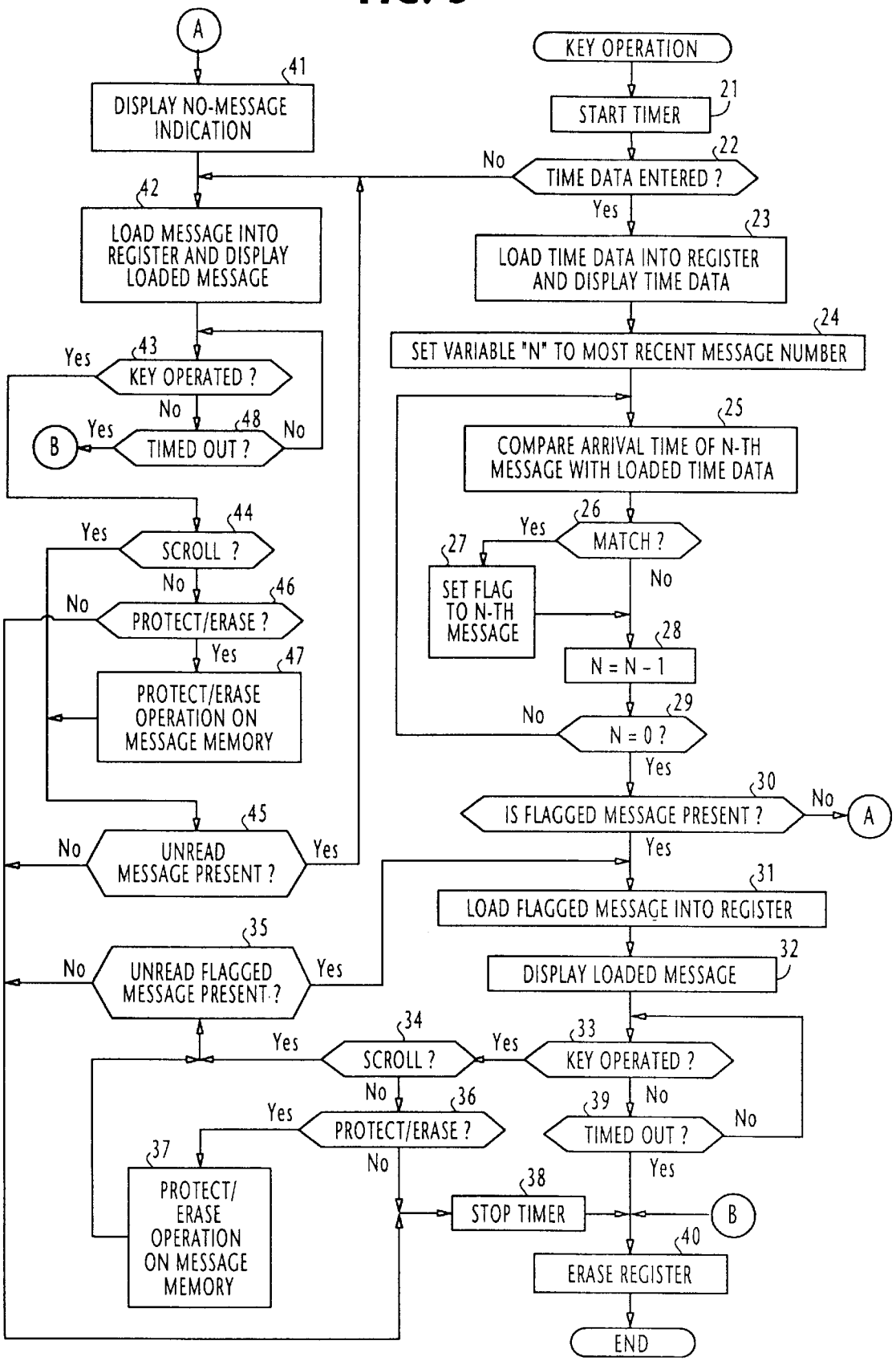
FIG. 3 shows, in a flowchart, the operation of a controller of the pager according to a first embodiment of the present invention.

According to a first embodiment of the present invention, the controller 3 operates according to the flowchart of FIG. 3.

When the user operates the keypad 9 for reading stored messages, the timer 11 is started (step 21). Through the keypad the user enters time data indicating a desired date, a desired time-of-day, and a desired minute. Alternatively, a desired time span may be entered. At step 22, controller 3 determines whether such user-entered time data is present.

If there is no user-entered time data) the controller proceeds from step 22 to step 42 to start reading a stored message beginning with the most recent arrival from the message memory 5 and loading it into register 7 and displaying the loaded message on the display panel 8. If a key operation is detected at step 43, flow proceeds to step 44 to determine whether it is a scroll operation. If so, the controller proceeds from step 44 to 45 to check to see if there is still a stored message. If there is one, flow returns to step 43 to repeat the process on the next message. If the key operation is not a scroll operation, flow proceeds to step 46 to determine if it is a protect/erase operation. If so, flow proceeds to step 47 to perform a protect/erase operation on the message stored in memory 5 which is currently displayed, and proceeds to step 45. If the key operation at step 43 is determined to be not the protect/erase operation, the controller proceeds to step 38 to stop the timer. If no key operation is detected within the time out period of the timer (step 48), flow proceeds to step 40 to erase the content of register 7 and terminates the routine. If protect key operation is detected for a given message, a protect indication is given to the protect field 5D of the given message.

If user-entered time data is present, the decision at step 22 is affirmative and flow proceeds to step 23 to load the entered time data into the register 7 and display it on the display panel 8 to allow the user to visually confirm the input data. At step 24, a variable "N" is set equal to the message number of the most recent arrival. Flow proceeds to step 25, where the controller reads the arrival time of the N-th message from message memory 5 and compares it with the time data loaded in register 7. If they match (step 26), flow proceeds to step 27 to set a flag bit in the message memory 5 corresponding to the N-th message. Variable N is then decremented by one at step 28 and its value is compared with zero at step 29. If variable N is not equal to zero, flow returns from step 29 to step 25 to repeat the above process on the arrival time of the next flagged message until variable N is decremented to zero.

As a result, flag bits will be set in those fields of message memory 5 whose arrival times correspond to the user-entered time data. Controller 3 then proceeds to step 30 to check to see if there is at least one flagged message. If so, a flagged message is loaded from the message memory 5 into the register 7 (step 31), overwriting the user' entered time data, and then displayed on the display panel 8 (step 32).

At step 33, the controller checks to see if one of the keys is operated. If so, the controller determines, at step 34, whether the scroll key is operated. If so, flow proceeds to step 35 to erase the flag bit of the currently displayed message and returns to step 30 to check to see if there is still a flagged message in the message memory 5. If so, the next flagged message will be loaded into register 7 and displayed (steps 31, 32).

If the decision at step 34 is negative, flow proceeds to step 36 to check to see if the key operation is a message protect/erase operation. If this is the case, controller 3 proceeds to step 37 to perform a protect/erase operation to protect or erase the flagged message in the message memory 5 which is currently displayed, and returns to step 30. If the decision at step 36 is negative, the timer is stopped (step 38) and flow proceeds to step 40 to erase the content of register 7.

If there is no key operation following the display of a message (step 32), the controller loops steps 33 and 39 to erase the content of register 7 at step 40 upon expiration of the timer.

If flagged messages are no longer present after the controller has executed steps 30 to 37, the controller exits from step 30 and enters step 41 to display a zero-flagged-message indication, and then proceeds to step 43. If the user subsequently operates the scroll key (step 44), a message display routine will be performed on those messages which have not been flagged previously at step 27.

It will be seen that, since the message number of the most recent arrival is the highest number, only those messages received at or within the time specified by the user-entered time data are displayed, starting with the most recent arrival. As a result, the user is not required to search through all the received messages to find desired ones. If the user enters time data "xx:xx. 26. xx. 1996", for example, only those messages received at the 26th day of each month of the year 1996 are flagged and displayed. The desired time span may be specified by the start and end times, and alternatively by a desired instant accompanied with an indication "earlier than" or "later than".

Figure 4:
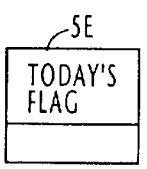
FIG. 4 shows an additional part of the message memory for storing a flag bit according to a second embodiment of the present invention.

FIG. 4 shows part of the message memory 5 for allowing the user to enter a flag bit by ;he operation of a special key (not shown) and processing the entered bit according to a second embodiment of this invention. The flag bit stored in this memory part, or today's flag field 5E indicates that the day-of-month and year of the day on which the flag bit is entered be read from the time-keeping device 10 and loaded into the register 7. This is intended to display only those messages received on that day. Since this automatically sets the range of messages to be displayed as will be described hereinbelow, the user is not required to enter time data as in the case of the first embodiment.

Figure 5:
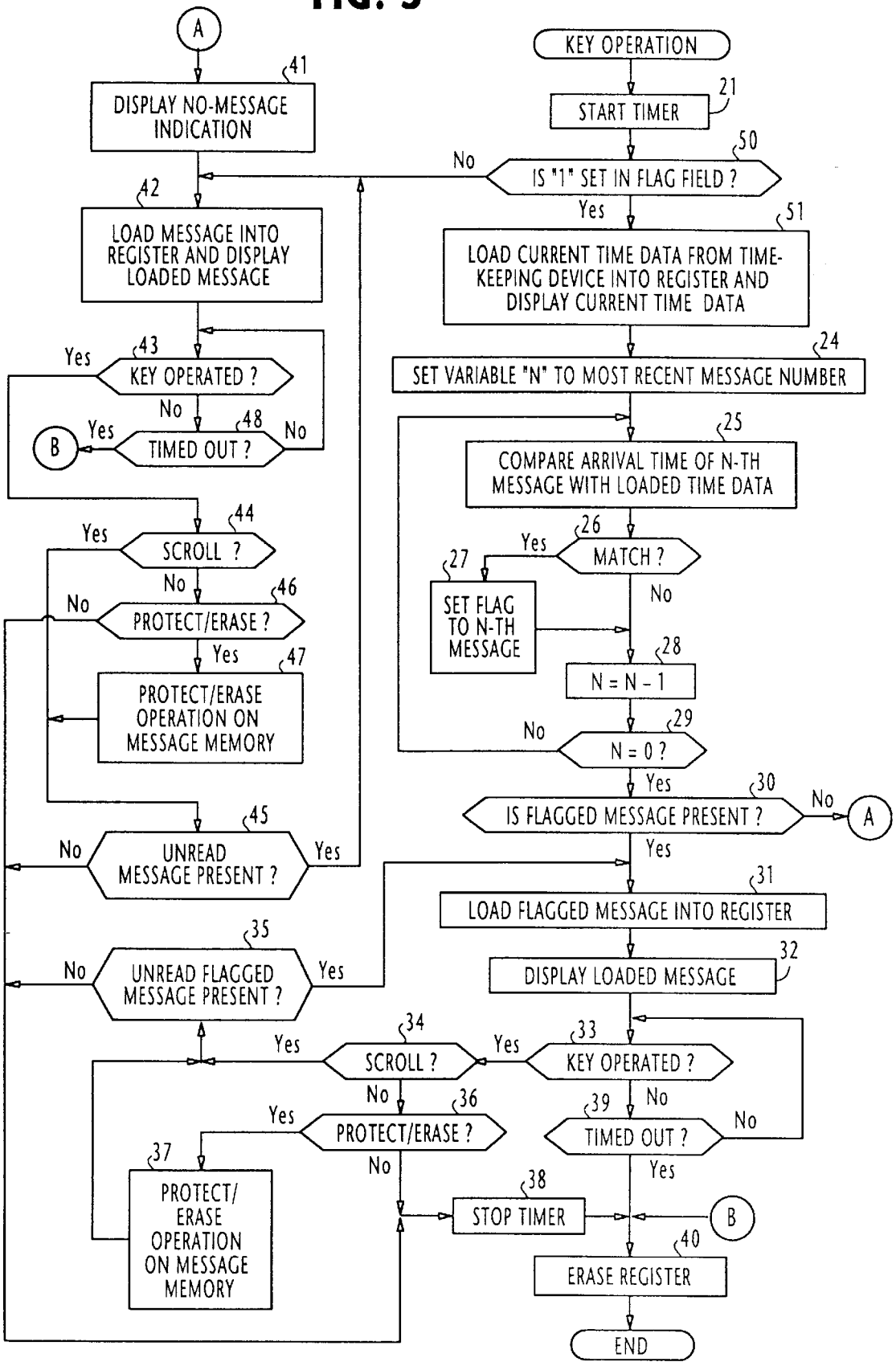
FIG. 5 shows, in a flowchart, the operation of the controller according to the second embodiment of the present invention.

The flowchart shown in FIG. 5 shows the operation of the controller according to the second embodiment. In FIG. 5, parts corresponding in significance to those in FIG. 3 are marked by the same numerals as those used in FIG. 3, the description thereof being omitted for simplicity. FIG. 5 differs from the previous embodiment in that steps 50 and 51 are used instead of steps 22 and 23 of FIG. 3. At step 50 following the starting of the timer (step 21), controller 3 checks to see if a flag bit "1" is set in the today's flag field 5E. If not, flow branches out to step 42 to perform the conventional message display routine. If a flag bit is stored in the today's flag field 5E, flow proceeds from step 50 to step 51 to load today's day-of-month-year data from the time-keeping device 10 into the register 7. Variable "N" is then set to the message number of most recent arrival (step 24) and the arrival time (day-of-month-year) of the N-th message is compared with the time data stored in the register (step 25). As steps 25 to 29 are repeatedly executed, messages received this day are flagged and then successively displayed.

Figure 6:
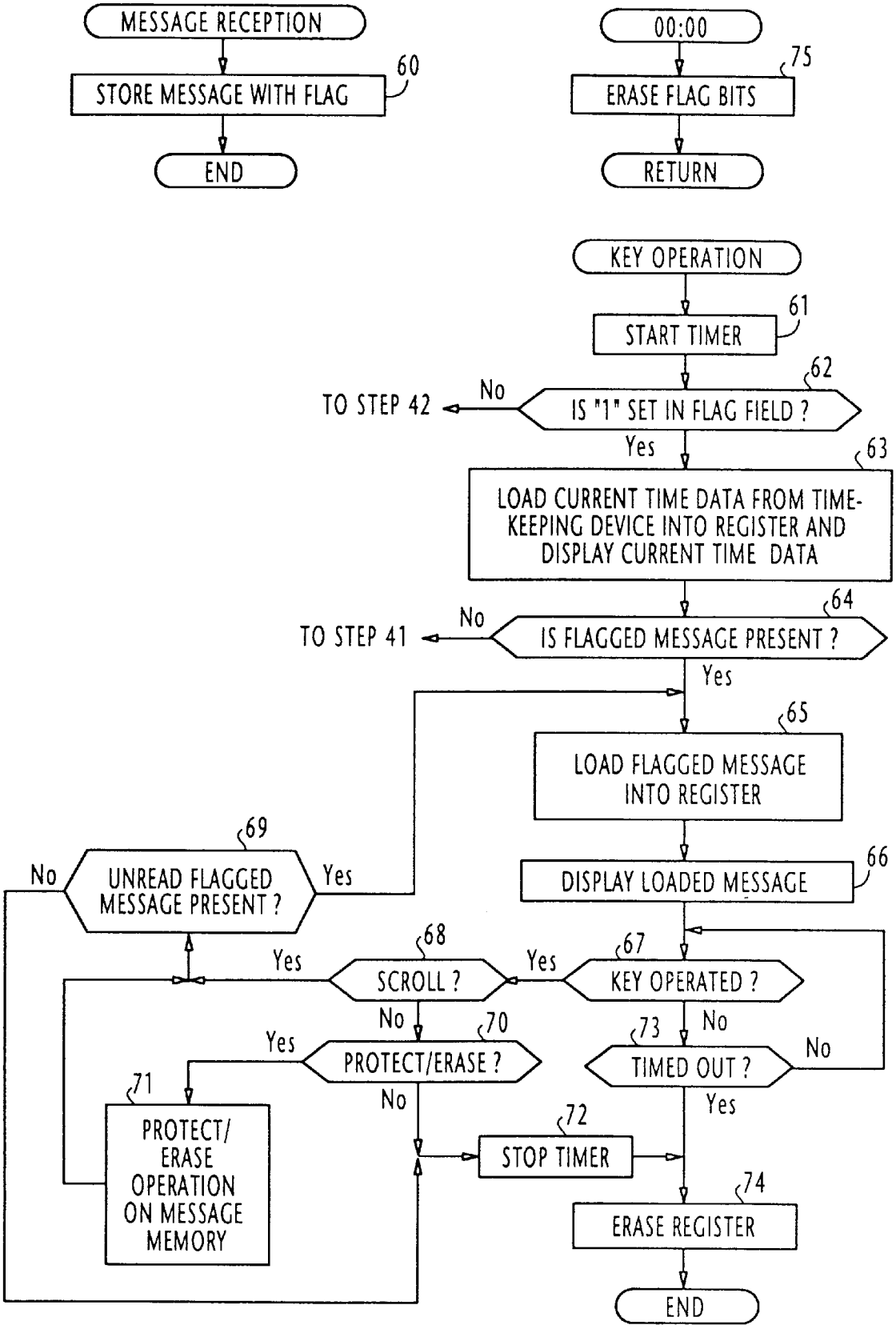
FIG. 6 shows, in a flowchart, the operation of the controller according to a third embodiment of the present invention.

A third embodiment of this invention is shown in FIG. 6 in which parts corresponding in significance to those in FIG. 5 are marked with the same numerals as those in FIG. 5. When a message is received and stored in a message field of the memory 5, a flag bit is also stored in the corresponding flag/protect field 5D at step 60. When the user operates a key on the keypad 9, the timer is started (step 61) and the presence/absence of a flag bit in the today's flag field 5E is checked (step 62). If no flag bit is stored in the field 5E, control proceeds to step 42. If a flag bit is stored, current time (time-of-day and day-of-month-year) is loaded from the time-keeping device 10 into the register 7 at step 63. Flow proceeds to decision step 30 to check for the presence of a flagged message. If at least one message has been received this day, flow proceeds from step 30 to step 31 to load a flagged message from the memory 5 into register 7 and the loaded message is displayed (step 31). By comparison between FIGS. 5 and 6 it is seen that in the third embodiment the flagging process of steps 24 to 29 of FIG. 5 is dispensed with. In addition, the flag erasing step 35 of FIG. 5 is replaced with flag erasing step 64 which is executed when the time-keeping device produces midnight hour "00:00".

What is claimed is:

1. A radio display pager for receiving messages addressed to the pager, comprising:

a memory for storing the received messages;

a display unit;

a keypad for allowing a user to enter time indication; and control circuitry for detecting a group of messages according to said time indication and causing each of the detected messages to be displayed on said display unit in response to a key operation on said keypad by said user.

2. A radio display pager as claimed in claim 1, wherein said control circuitry is arranged to:

compare arrival time of each message stored in said memory with the entered time indication;

attach a flag to each message if the arrival time of the message coincides with the entered time indication and store the flag in said memory in a location corresponding to the message; and cause each message to which the flag is attached to be displayed on said display unit in response to said key operation.

3. A radio display pager as claimed in claim 1, wherein said control circuitry is arranged to erase the flag of each message when the message is displayed.

4. A radio display pager as claimed in claim 1, wherein said control circuitry is arranged to:

respond to a first flag stored in a specified location of the memory for comparing arrival time of each message stored in said memory with day of month of the day on which the flag is stored in said memory;

attach a second flag to each message if the arrival time of the message coincides with said day of month and store the second flag in said memory in a location corresponding to the message; and cause each message to which the second flag is attached to be displayed on said display unit in response to said key operation.

5. A radio display pager as claimed in claim 4, wherein said control circuitry is arranged to erase the second flag of each message when the message is displayed.

6. A radio display pager as claimed in claim 1, wherein said control circuitry is arranged to:

attach a flag to each message when each message is received and store the flag in said memory in a location corresponding to the message; and cause each message to which said flag is attached to be displayed on said display unit in response to said key operation.

7. A radio display pager as claimed in claim 6, wherein said control circuitry is arranged to erase the flag of each message at midnight.

8. A method of displaying messages stored in a memory of a radio display pager, comprising the steps of:

a) determining whether or not time indication is entered by a user;

b) if the time indication is entered, detecting a group of messages according to said time indication and displaying each of the detected messages in response to a key operation on said keypad by said user; and c) if the time indication is not entered, display each of the stored messages in response to a key operation on said keypad by said user.

9. The method of claim 8, wherein the step (b) comprises the steps of:

b1) comparing arrival time of each message stored in said memory with the entered time indication;

b2) attaching a flag to each message if the arrival time of the message coincides with the entered time indication and storing the flag in said memory in a location corresponding to the message; and b3) displaying each message to which the flag is attached in response to said key operation.

10. The method of claim 9, further comprising the step of erasing the flag of each message when the message is displayed by the step (b3).

11. The method of claim 8, wherein the step (b) comprises the steps of:

b1) responding to a first flag stored in a specified location of the memory for comparing arrival time of each message stored in said memory with day of month of the day on which the flag is stored in said memory;

b2) attaching a second flag to each message if the arrival time of the message coincides with said day of month and storing the second flag in said memory in a location corresponding to the message; and b3) displaying each message to which the second flag is attached in response to said key operation.

12. The method of claim 11, further comprising the step of erasing the second flag of each message when the message is displayed by the step (b3).

13. The method of claim 8, further comprising the steps of attaching a flag to each message when each message is received and storing the flag in said memory in a location corresponding to the message, and wherein the step (b) comprises the step of displaying each message to which said flag is attached in response to said key operation.

14. The method of claim 13, further comprising the step of erasing the flag of each message at midnight.

* * * * *